US005225625A

United States Patent [19]

Rochelle et al.

[11] Patent Number: 5,225,625

[45] Date of Patent: Jul. 6, 1993

[54] SAFETY DEVICE FOR AN AUTOMATIC WEAPON WITH "FLOATING" FIRING

[75] Inventors: Marc R. Rochelle, Bourges; Georges H. Simon, Saint Germain du Puy; Jean-François G. Lescure, Bourges, all of France

[73] Assignee: GIAT Industries, France

[21] Appl. No.: 779,847

[22] Filed: Oct. 21, 1991

[30] Foreign Application Priority Data

Jul. 12, 1990 [FR] France ..... 90 08873

[51] Int. Cl.[5] ..... F41A 17/18

[52] U.S. Cl. ..... 89/9; 89/11

[58] Field of Search ..... 89/9, 11, 12, 13.05, 89/13.1

[56] References Cited

U.S. PATENT DOCUMENTS 4,131,052 12/1978 Skahill ..... 89/11
4,154,143 5/1979 Pechamat et al. ..... 89/11
4,164,890 8/1979 Elmore et al. ..... 89/11
4,508,006 4/1985 Post et al. ..... 89/9
4,550,641 11/1985 Bruderer et al. ..... 89/12
4,699,040 10/1987 Menges ..... 89/9
4,841,835 6/1989 Bohler et al. ..... 89/12

FOREIGN PATENT DOCUMENTS 2372409 11/1976 European Pat. Off. .
2052023 1/1981 United Kingdom .

*Primary Examiner*—Michael J. Carone
*Attorney, Agent, or Firm*—Parkhurst, Wendel & Rossi

[57] ABSTRACT

The invention relates to a safety device, for an automatic weapon with "floating" firing, including a rotating drum (2) driven by an external motor for driving a breech with a reciprocating motion.

The safety device includes locking devices (14) for the rotating of the drum in each cycle, and control devices for retracting the locking devices when the weapon recoils, the control devices being fitted to act on the locking devices for a predetermined recoil travel distance, independently of the weapon recoil starting position.

6 Claims, 3 Drawing Sheets

SAFETY DEVICE FOR AN AUTOMATIC WEAPON WITH "FLOATING" FIRING

BACKGROUND OF THE INVENTION

Figure 1:
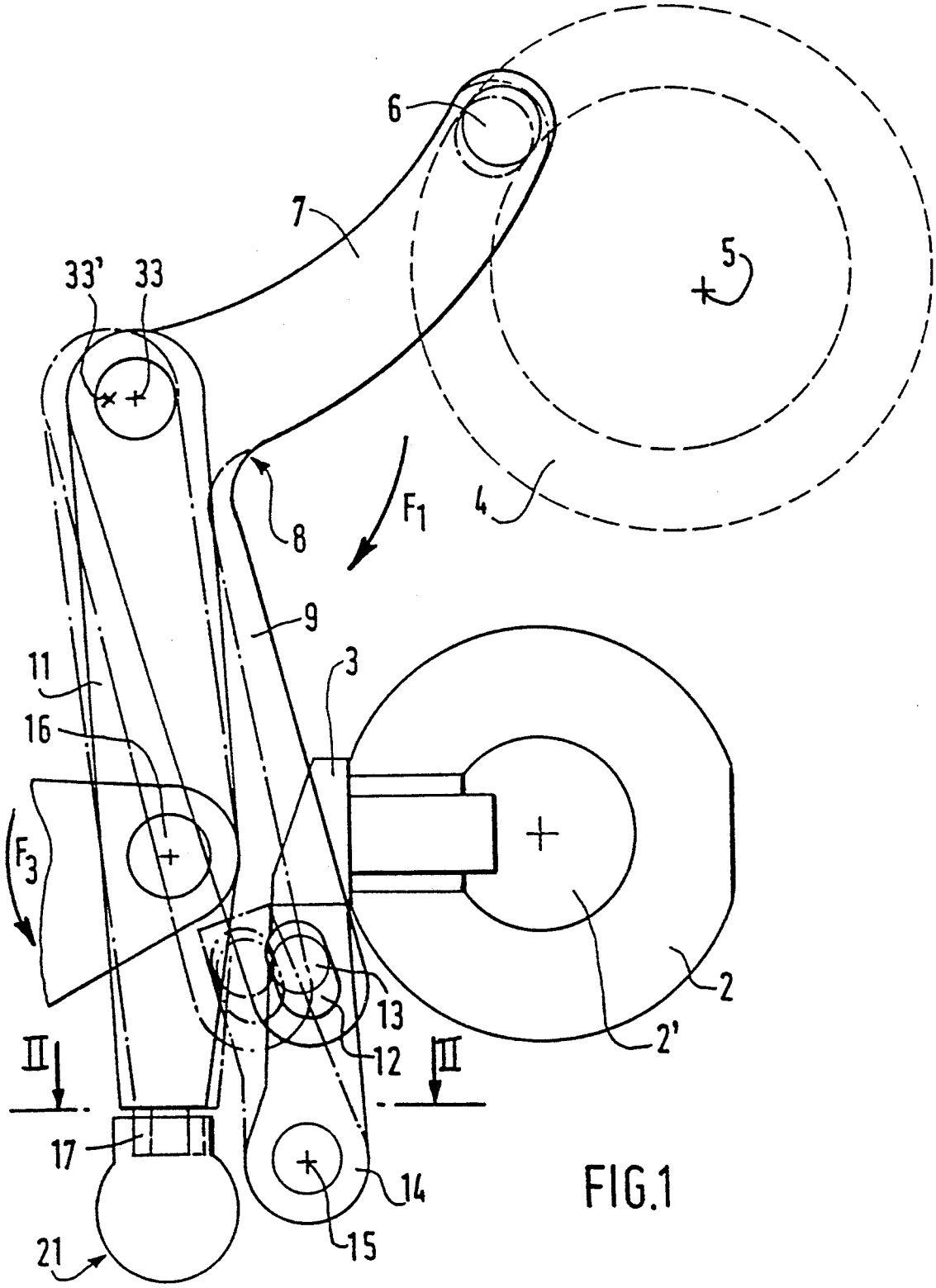

The present invention relates to a safety device for an automatic weapon with "floating" firing.

FR-A-2 372 409 relates to a known automatic weapon with a rotating drum driven by an external motor to drive a breech with a reciprocating movement. This document reveals the risks posed by such weapons when a misfire occurs due to the separation of the "firing" and "automatic device" functions. To remedy these disadvantages, an interlocking device is provided that enables the breech to be secured in the closed position and devices sensitive to firing are provided in order to move the interlocking device away for a moment to allow the breech to open. However, such an arrangement is not applicable to an automatic weapon with floating firing. Floating fire relates to an automatic weapon in which each shot after the first in a burst of shots is fired before the recoiling part of the weapon has regained its original position, the effect of which is to reduce the forces on the supporting structure.

In such a case, there is no fixed reference mark provided for determining the position of the breech since the starting position for the recoil is not known.

SUMMARY OF THE INVENTION

The present invention aims to provide a safety device for use with an automatic weapon with floating firing.

Therefore, the object of the invention is a safety device for an automatic weapon with floating firing having a rotating drum driven by an external motor for driving a breech with reciprocating movement and interlocking devices for the breech, including immobilizing devices for the weapon on each cycle and control devices for retracting the immobilizing devices when the weapon recoils, the control devices being arranged so as to act on the immobilizing devices during a predetermined recoil distance independently of the initial position for the recoil.

In a particular embodiment of the invention, the control devices comprise a component that is fixed when the recoil starts and is then driven by the recoil of the weapon after the predetermined distance of travel.

Advantageously, the component is held fixed by friction during the predetermined distance of travel and may comprise a spindle secured by a metal tubular braid that is rigid with the carriage of the weapon.

In order to provide the predetermined distance of travel, the component is preferably arranged to move in relation to the recoiling part of the weapon between two limit stops that are rigid with this part.

In an initial embodiment of the invention, the immobilizing devices are arranged to stop the rotation of the drum. In a particular embodiment, the immobilizing devices comprise a roller that works in conjunction with a cam that performs one revolution per cycle, the axis of rotation of the lever being movable under the effect of the control devices.

More particularly, the immobilizing devices may comprise a pawl arranged to work in conjunction with a limit stop that depends on the rotating drum, the position of the pawl being controlled by the other end of the lever.

The axis of rotation of the lever may be mounted to rotate at one end of another lever with a fixed axis and whose other end has a cam follower that works in conjunction with a ramp of the component.

In a second embodiment of the invention, the immobilizing devices are arranged so as to secure the interlocking devices of the breech in the locked position.

The immobilizing devices may comprise a lever arranged to fit into a notch of the component when this is the position that it occupies until just before the recoil starts.

Figure 2A:
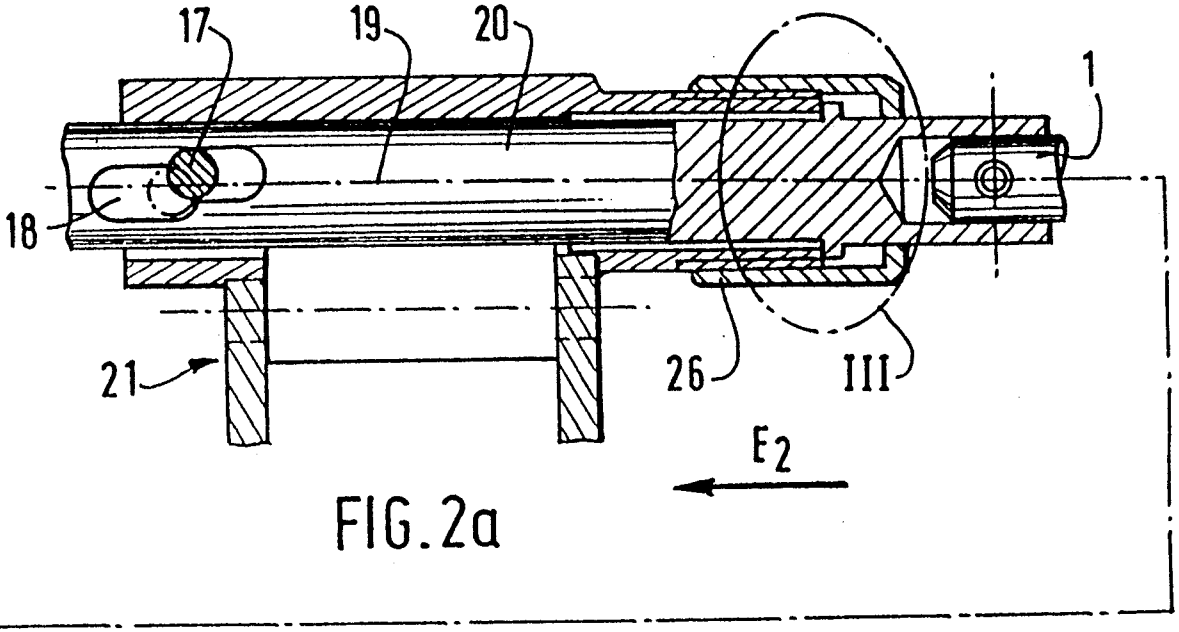
Figure 3:
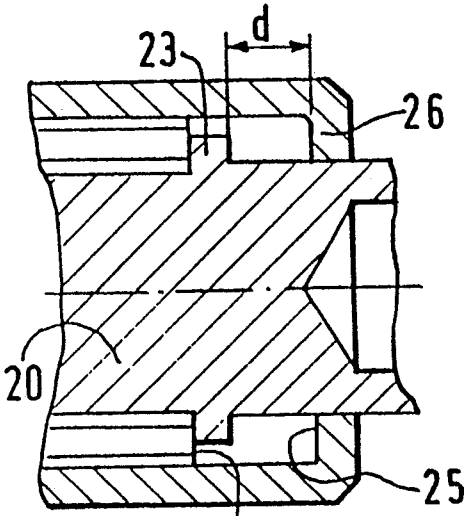
Figure 2B:
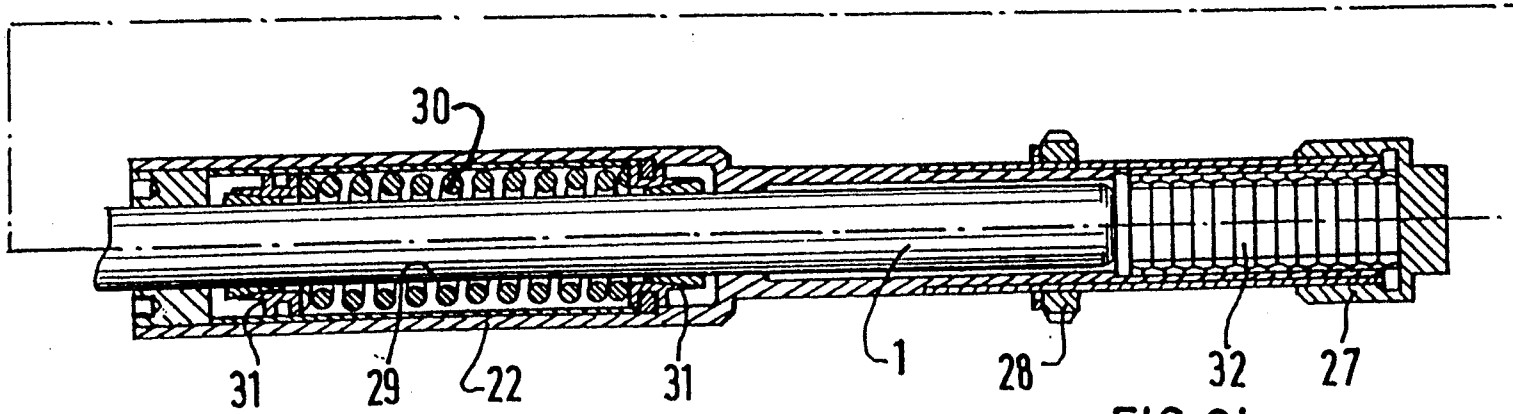
Figure 4:
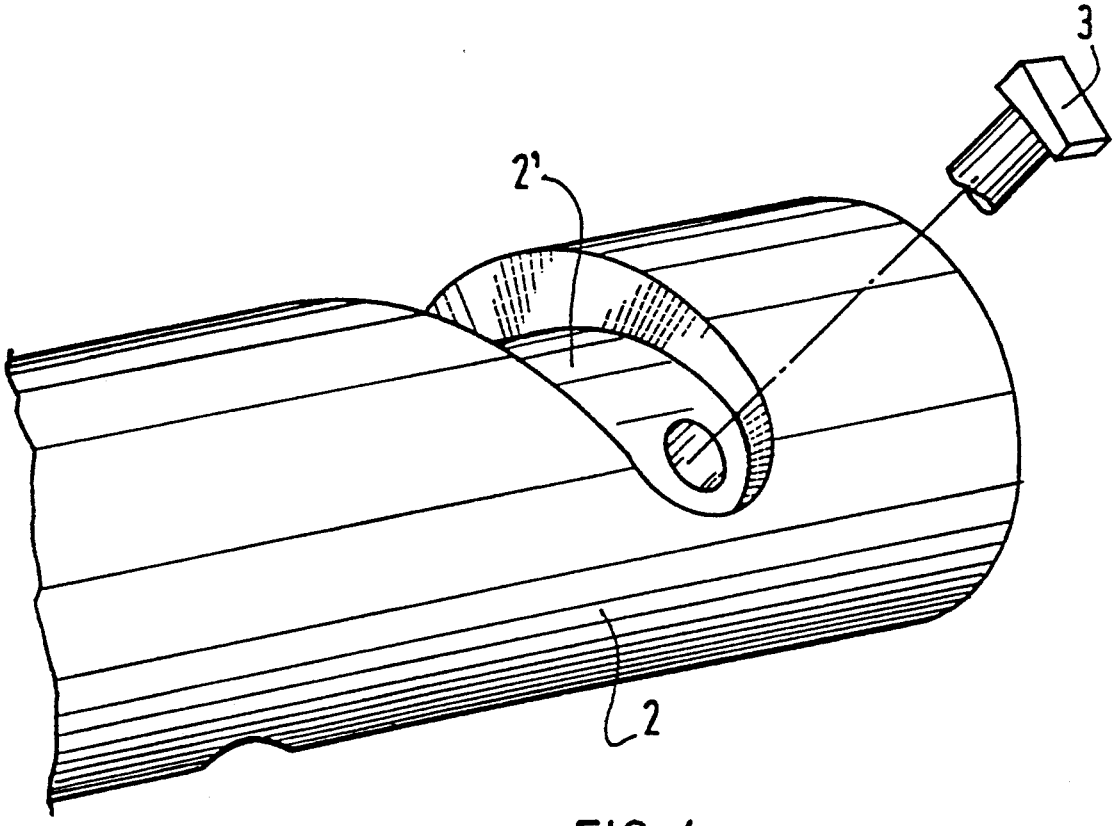
Figure 5:
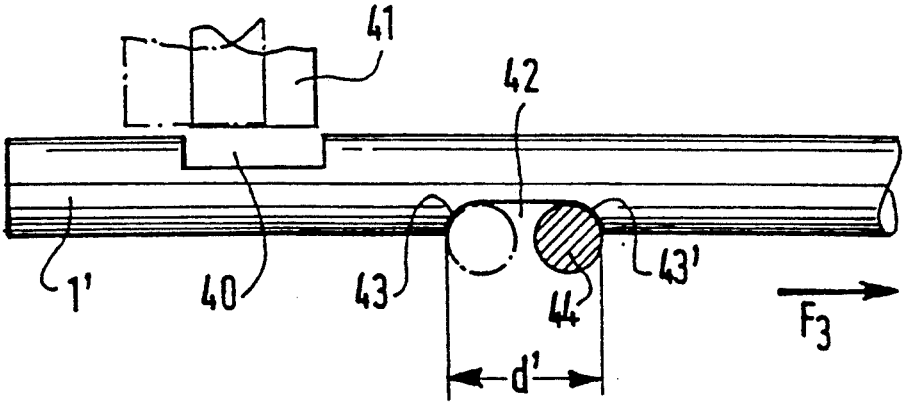

By way of example, two particular embodiments of the invention shall now be described with reference to the appended drawing appended, in which:

FIG. 1 is an elevation view of an initial embodiment of the invention,

FIGS. 2*a* and 2*b* form a view in two parts in partial cross section along the line II—II of FIG. 1, FIG. 3 is a plan view on a larger scale of detail 3 of FIG. 2*a*, FIG. 4 is a perspective view of the rear part of the rotating drum, and FIG. 5 represents a second embodiment of the invention.

Reference will first be made to FIGS. 1 to 4.

The elements shown in FIG. 1 belong to the recoiling part of the weapon.

If we refer now to FIGS. 1 and 4, the rotating drum of the weapon can be seen in 2, inside of which is fitted a dampener having a push rod 2'. A limit stop is mounted rigid with the push rod 2' of the dampener and it can move in a helicoidal groove made in the drum 2. Thus, when the limit stop 3 is immobilized, the rotary movement of the drum is gradually transformed into a translational movement of the pusher rod 2' so that the rotation of the drum 2 is gradually stopped.

A cam 4 having a groove receiving roller 6 is shown. Cam 4 is driven in synchronization with the drum 2, rotating about an axis 5. The cam 4 is oval or eccentric in shape, in relation to the axis 5.

The cam 4 is fitted to make one revolution with each firing of the weapon. If the drum 2 makes 4 revolutions with every firing, the cam 4 therefore turns four times as slowly as the drum 2.

A roller 6 mounted on one end of the arm 7 of an elbowed lever 8 is fitted so as to be guided inside the cam 4.

The lever 8 is jointed, at the junction between its two arms 7 and 9, and at one end of another lever 11.

The end of the arm 9 of the elbowed lever 8 forms an extended slot 12 in which a dog pin 13 fixed at one end of a pawl 14 mounted at its other end to rotate about an axis 15 that is fixed in relation to the structure of the recoiling part of the weapon.

The lever 11 is jointed at its middle about an axis 16 that is fixed in relation to the structure of the recoiling part of the weapon, and its end that is opposite the joint of lever 8 holds a roller 17 engaged in an S-shape cam 18 (FIG. 2*a*) made in a component 20. The central part of the cam 18 forms a slope in relation to the axis 19 of the component 20 which slides in the direction of the axis 19 in relation to the recoiling structure 21 of the weapon.

The component 20 is rigid at its end with the aforementioned rod 1, which slides inside a tubular part 22.

The end of component 19 that is nearest to the rod 1 forms a shoulder 23 which may move between a primary limit stop 24 made at the end of the part of the structure 21 that guides the sliding component 20 and a second limit stop 25 formed by the end cap 26 that blocks up this tubular part.

As previously mentioned, the tubular part 22, as well as its end cap 27 and its adjusting screw 28 are rigid with the carriage of the weapon, i.e. its non-recoiling part.

Inside the tubular part 22, the rod 1 is enclosed in a tubular metal sheathe 29, tensioned with a spring 30, arranged between both its ends that are trapped in taper devices 31, one of which is attached inside the tubular part 22. This tension creates a tendency to shrink the tubular metal braid 29, thus causing friction and therefore engaging of the rod 1.

Finally, the end of the tubular part 22 is fitted with compression washers 32 which tend to push the rod leftwards in FIG. 2.

If we now come back to FIG. 1, it can be seen that in the position of levers 8 and 11 shown in solid lines, the pawl 14 is brought to a position in which it is in the trajectory of limit stop 3 and in which, consequently, it stops the rotating drum 2. This position is the one that corresponds to the firing of the ammunition, a position in which the roller 6 is in its furthermost position from axis 5 due to the cam 4.

When the cam revolves, i.e. when not in the firing position, it produces a swing in the direction of the arrow F1 about axis 33, the effect of this rotation being to move the pawl 14 away and to consequently allow the free rotation of the drum 2.

Consequently, it can be noted that if there is no recoil of the weapon when firing, i.e. if the shot is not released, the pawl 14 immobilizes drum 2 and hence prevents the breech from opening.

If, on the other hand, there is a recoil motion during the firing phase in the direction of arrow F2, the rod will be momentarily rigid with the tubular part 22 and hence, with the carriage of the weapon, due to the friction caused by the braid 29.

The roller 17 therefore moves in the slope of cam 18 from its position shown in a solid line to its position shown in dots and dashes, causing the lever 11 to swing about axis 16 in the direction of the arrow F3. The effect of this swinging is to move axis 33 to 33', the levers 11 and 8 then taking up their position shown in dots and dashes in FIG. 1.

The end of the arm 9 of this lever 8 will hence be moved away from the drum 2, its slot 12 driving dog pin 13, so that the pawl 14 also adopts its position shown in dots and dashes where it no longer prevents the passage of the limit stop 3 and hence the rotation of the drum 2.

When the limit stop 25 comes into contact with the shoulder 23 rod 1 and component 20 are then driven against after recoiling structure travels distance d.

When, at the end of the recoil, the structure of the weapon sets off again in an opposite direction to the arrow F2, the rod 1 is again rigid with the carriage of the weapon due to the friction exerted by the braid 29, until the shoulder 23 comes into contact with the limit stop 24, after which the rod 1 and component 20 again follow the recoiling structure of the weapon. Hence, we are back in the original position in order to allow the pawl 14 to be retracted at the following firing phase if the firing is good, or the drum 2 to be immobilized if there is a misfiring.

At the end of the burst, there is generally a counter-recoil, i.e. the recoiling part of the weapon goes past its neutral position before returning to it. During this return, the shoulder 23 stops against limit stop 25. However, the effect of the springy washers 32 is to bring this shoulder 23 into contact with the limit stop 24 when the weapon is again in steady state.

Referring now to FIG. 5, a rod 1' can be seen mounted on the side of the arrow F3 in the same way as rod 1 so as to permit its buffering during a trajectory d after the recoil of the weapon has started.

This rod 1' comprises an initial notch 40 arranged before the recoil has started opposite a lever 41 that pivots about an axis (not shown) to lock or unlock by any suitable means the unlocking devices of the breech of the weapon. In its upper position shown in the drawing the lever 41 allows the unlocking of the breech while in its lower position, when it is engaged in the notch 40, it prevents this unlocking from occurring.

The rod 1' comprises a second notch 42 whose edges form two limit stops 43 and 43' for a rod 44.

Of course, the lever 41 and the rod 44 belong to the recoiling part of the weapon. Their position in solid lines corresponds to the moment preceding the start of the recoil and their position in dashes and dots corresponds to a travel distance d' after the recoil has started.

The limit stops 43 and 43' function in the same manner as the limit stops 24 and 25 of FIG. 3.

It can be seen that when no recoil is produced the lever 41 falls into the groove 40 and prevents then the unlocking of the breech. On the other hand, when recoil occurs, the lever 41 remains in its upper position and hence allows this unlocking.

Thus, the unlocking of the breech is only possible if recoil occurs and vice versa, is prevented if firing does not take place.

Different variations and modifications may of course be made to the preceding description without departing from the scope or the spirit of the invention.

In particular, the two embodiments of the invention may be used on a single weapon at the same time.

We claim:

1. A safety device for a floating firing type weapon, said weapon being supported by a carriage and comprising an external motor and a rotary drum driven by said motor for driving a breech with reciprocating movement, said safety device comprising:

locking means for locking the breech in a firing position, said locking means being fixed to the weapon; and control means for moving the locking means into an unlocked position when the weapon recoils, said control means comprising:

a) an intermediate component connected to the weapon and the carriage;

b) fixing means to fixedly secure said intermediate component to said carriage during a predetermined recoil distance of said weapon; and c) driving means to drive said intermediate component with said weapon during recoil of said weapon after said weapon has passed said predetermined recoil distance, whereby said locking means is urged into said unlocked position by said intermediate component while said intermediate component is fixedly secured to said carriage.

2. The safety device of claim 1, wherein said fixing means comprises a friction device positioned between said intermediate component and the carriage.

3. The safety device of claim 1, wherein said driving means comprises a first limit stop and a second limit stop spaced apart said predetermined recoil distance.

4. The safety device of claim 1, wherein said intermediate component comprises a rod extending between first and second tubular guide members, wherein said first tubular guide member is fixed to said weapon and includes said driven means, and wherein said second tubular guide member is fixed to said carriage and includes said fixing means.

5. The safety device of claim 4, wherein said rod comprises a cam forming groove, and wherein the locking means comprises a roller guide in said cam forming groove, said roller being displaced in said cam forming groove while said weapon recoils through said predetermined recoil distance such that said locking means is moved into said unlocked position.

6. The safety device of claim 5, wherein said locking means comprises a pivoting pawl adapted to stop the rotation of the rotating drum, a first lever acting on said pawl for moving said pawl into a locked position to stop rotation of the drum for firing of the weapon, said first lever being driven by the external motor of the weapon, said locking means further comprising a second lever carrying said roller, said second lever joined to said first lever to urge said pawl from said locked position to said unlocked position via movement of said roller in said cam forming groove.

* * * * *